US007422422B2

(12) United States Patent
Haller et al.

(10) Patent No.: US 7,422,422 B2
(45) Date of Patent: Sep. 9, 2008

(54) COMPRESSOR ASSEMBLY WITH PRESSURE RELIEF VALVE FITTINGS

(75) Inventors: David K Haller, Adrian, MI (US); Zer Kai Yap, Ypsilanti, MI (US)

(73) Assignee: Tecumseh Products Company, Ann Arbor, MI (US)

( * ) Notice: Subject to any disclaimer, the term of this patent is extended or adjusted under 35 U.S.C. 154(b) by 500 days.

(21) Appl. No.: 10/924,440

(22) Filed: Aug. 24, 2004

(65) Prior Publication Data

US 2006/0045760 A1 Mar. 2, 2006

(51) Int. Cl.
*F04B 49/00* (2006.01)
*F04B 25/00* (2006.01)
*F04B 3/00* (2006.01)

(52) U.S. Cl. ..... 417/310; 417/252; 417/307; 417/902

(58) Field of Classification Search ..... 417/252, 417/307, 308, 309, 310, 902
See application file for complete search history.

(56) References Cited

U.S. PATENT DOCUMENTS

| | | | | |
|---|---|---|---|---|
| 4,186,562 | A | 2/1980 | Tyree, Jr. | 62/62 |
| 5,219,281 | A * | 6/1993 | Caillat et al. | 418/55.6 |
| 5,287,705 | A | 2/1994 | Roehrich et al. | 62/50.3 |
| 5,315,840 | A | 5/1994 | Viegas et al. | 62/167 |
| 5,320,167 | A | 6/1994 | Johnson et al. | 165/64 |
| 5,427,506 | A * | 6/1995 | Fry et al. | 417/307 |
| 5,542,261 | A | 8/1996 | Albertson et al. | 62/174 |
| 5,644,930 | A | 7/1997 | Albertson et al. | 62/475 |
| 5,730,216 | A | 3/1998 | Viegas et al. | 165/233 |
| 6,112,532 | A | 9/2000 | Bakken | 62/174 |
| 6,227,812 | B1 * | 5/2001 | Kawaguchi et al. | 417/222.2 |
| 6,321,544 | B1 | 11/2001 | Kanai et al. | 62/126 |
| 6,574,978 | B2 | 6/2003 | Flynn et al. | 62/278 |
| 6,584,785 | B1 | 7/2003 | Karl | 62/117 |
| 6,695,592 | B2 * | 2/2004 | Yokomachi et al. | 417/308 |
| 2002/0017106 | A1 | 2/2002 | Flynn et al. | 62/156 |
| 2002/0146328 | A1 | 10/2002 | Yokomachi et al. | 417/307 |

FOREIGN PATENT DOCUMENTS

| | | |
|---|---|---|
| JP | 2002061571 | 2/2002 |
| JP | 2002221376 | 8/2002 |
| JP | 2002243290 | 8/2002 |

OTHER PUBLICATIONS

Office Action from corresponding Canadian Application No. 2,516,747.

* cited by examiner

*Primary Examiner*—Devon Kramer
*Assistant Examiner*—Patrick Hamo
(74) *Attorney, Agent, or Firm*—Baker & Daniels LLP

(57) ABSTRACT

A compressor assembly including a housing that encloses a sealed interior volume and defines an inlet opening and an outlet opening. Refrigerant is communicated from a suction line into the interior volume through the inlet opening. Refrigerant is communicated from the interior volume to a discharge line through the outlet opening. A first compressor mechanism is disposed within the interior volume and is adapted to compress the refrigerant. A first fitting is mounted on an exterior surface of the housing and is in communication with one of the inlet and outlet openings. The first fitting defines a first passageway for communicating the refrigerant between the one opening and a respective one of the suction and discharge refrigerant lines. The fitting further defines a first duct in communication with the first passageway. A first pressure relief valve is mounted in communication with the first duct.

12 Claims, 8 Drawing Sheets

COMPRESSOR ASSEMBLY WITH PRESSURE RELIEF VALVE FITTINGS

BACKGROUND OF THE INVENTION

1. Field of the Invention

The present invention relates to compressor assemblies for compressing high pressure fluid and, more particularly, to compressor assemblies having pressure relief valves.

2. Description of the Related Art

Compressor assemblies using a high pressure working fluid, such as carbon dioxide, are well known in the art. Such compressor assemblies typically include one or more compressor mechanisms operatively coupled to a motor. The motor and the compressor mechanisms are often hermetically sealed within a metal housing, which defines one or more sealed plenums for receiving the working fluid. The compression of a refrigerant or other working fluid, such as carbon dioxide, can result in relatively high pressures within the plenums of the housing. Thus, the housing must be made of a material having a strength and thickness sufficient to endure the pressures resulting from the compression of the working fluid. Such housings are typically made from a rigid metal, such as steel, and have a substantial thickness and the manufacture of such a compressor may be relatively difficult, time consuming and expensive. In addition, the resulting compressor may be undesirably heavy.

Pressure relief devices for relieving excessively high pressures within the housing are also known. These pressure relief devices may vent the working fluid either to the atmosphere or to a low pressure area within the refrigeration system. Some of these pressure relief devices are mounted within the interior of the housing while other pressure relief devices are installed on the lines that communicate fluid to and from the compressor assembly. These devices may complicate the manufacture of the compressor assembly when installed within the interior of the compressor housing or require additional post-manufacture installation when employed in the a refrigerant line separate from the compressor.

Although known pressure relief valves are effective at venting excessive pressures, improvements which facilitate the efficient manufacture and installation of compressors and related vapor compression systems employing pressure relief valves are desirable.

SUMMARY OF THE INVENTION

The present invention provides an improved compressor assembly having a pressure relief valve that can be efficiently manufactured and installed.

The present invention comprises, in one form thereof, a compressor assembly for compressing a refrigerant communicated to and from the assembly through a suction refrigerant line and a discharge refrigerant line respectively. The compressor assembly includes a housing that encloses a hermetically sealed interior volume and defines an inlet opening and an outlet opening. The refrigerant is communicated into the interior volume at a suction pressure through the inlet opening and is communicated from the interior volume at a discharge pressure through the outlet opening. A first compressor mechanism is disposed within the interior volume and is adapted to compress the refrigerant. A first fitting is mounted on an exterior surface of the housing and is in communication with one of the inlet and outlet openings. The first fitting defines a first passageway for communicating the refrigerant between the one opening and a respective one of the suction and discharge refrigerant lines. The fitting further defines a first duct in communication with the first passageway. A first pressure relief valve is mounted in communication with the first duct.

In another form, the compressor assembly includes a housing enclosing a hermetically sealed interior volume and defining an inlet opening and a discharge opening. The refrigerant is communicated into the interior volume at a suction pressure through the inlet opening and is communicated from the interior volume at a discharge pressure through the outlet opening. At least one compressor mechanism is disposed within the interior volume for compressing the refrigerant. An internal refrigerant chamber is defined by the compressor assembly and is disposed within the interior volume. The compressor assembly defines a refrigerant flow path between the inlet opening and the discharge opening. The internal refrigerant chamber is in communication with the flow path at a point where the refrigerant is at a pressure less than the discharge pressure. A third opening is defined by the housing and is in communication with the internal refrigerant chamber. A pressure relief valve is mounted on the compressor assembly exterior to the housing and is in communication with the internal refrigerant chamber through the third opening.

In yet another form, the compressor assembly of the present invention includes a housing enclosing a hermetically sealed interior volume and defining an inlet opening and a discharge opening. The refrigerant is communicated into the interior volume at a suction pressure through the inlet opening and is communicated from the interior volume at a discharge pressure through the outlet opening. First and second compressor mechanisms are disposed within the interior volume of the housing. The first compressor mechanism compresses the refrigerant from the suction pressure to an intermediate pressure, and the second compressor mechanism compresses the refrigerant from the intermediate pressure to the discharge pressure. An intermediate pressure chamber is defined by the compressor assembly and is disposed within the interior volume. The first and second compressor mechanisms are in communication with the intermediate pressure chamber such that refrigerant discharged from the first compressor mechanism is communicated to the intermediate pressure chamber and refrigerant within the intermediate pressure chamber is communicated to the second compressor mechanism. A third opening is defined by the housing and is in communication with the intermediate pressure chamber. A pressure relief valve is mounted on the compressor assembly exterior to the housing and is in communication with the intermediate pressure chamber through the third opening.

One advantage of the present invention is that it relieves excessive pressures within the compressor assembly, thereby preventing damage to the compressor assembly that could result from such excessive pressure. This may also, in some embodiments, allow the use of a thinner, lighter and less expensive housing.

Another advantage of the present invention is that it provides a fitting that allows a pressure relief valve to be mounted on the exterior surface of the housing, thereby allowing the pressure relief assembly to be manufactured as a component of the compressor assembly without modifying the interior of the housing or the components therein.

BRIEF DESCRIPTION OF THE DRAWINGS

The above mentioned and other features and objects of this invention, and the manner of attaining them, will become more apparent and the invention itself will be better understood by reference to the following description of embodiments of the invention taken in conjunction with the accompanying drawings, wherein.

Figure 1:
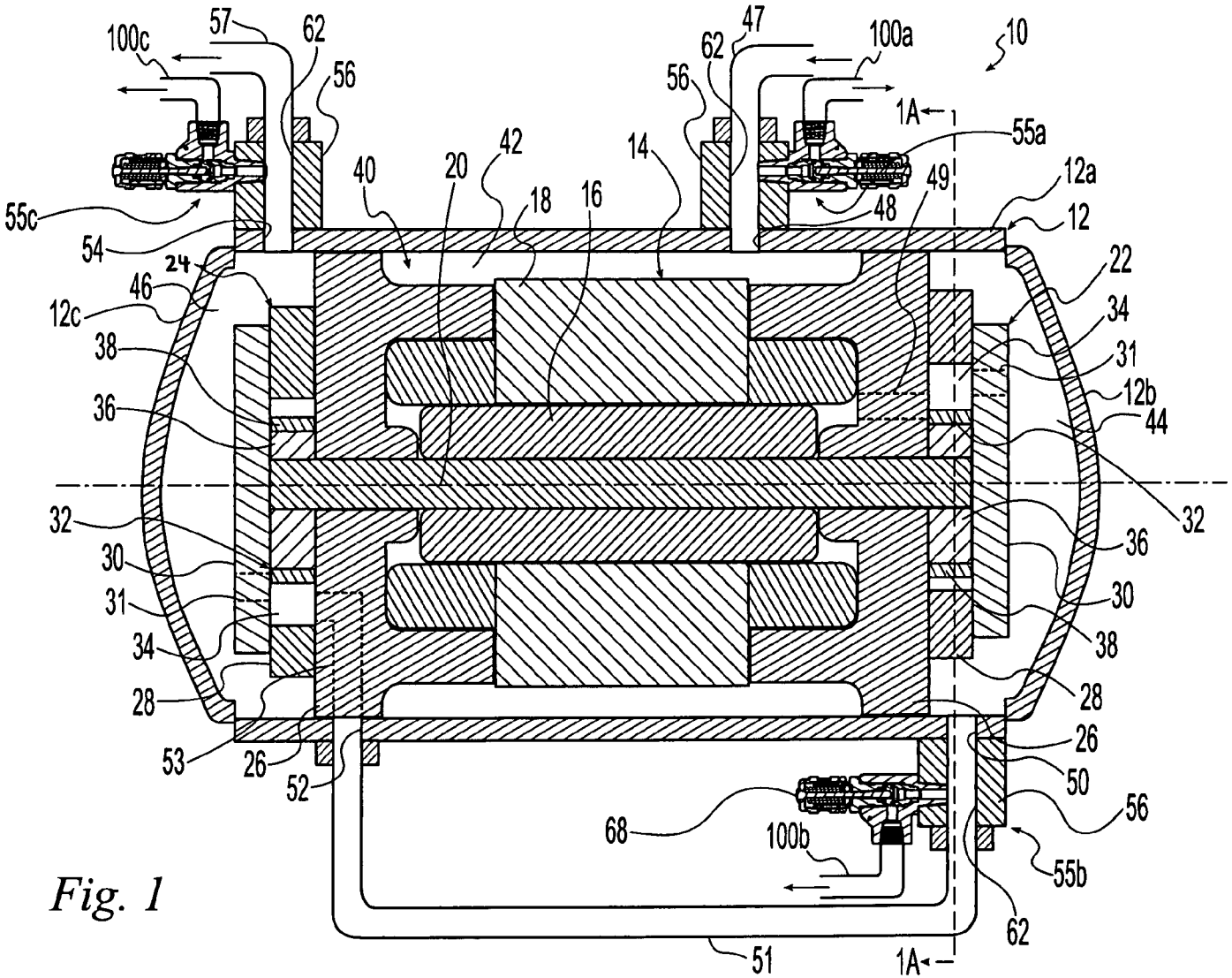
FIG. 1 is a sectional view of one embodiment of a compressor assembly according to the present invention.

Corresponding reference characters indicate corresponding parts throughout the several views. Although the exemplification set out herein illustrates embodiments of the invention, in several forms, the embodiments disclosed below are not intended to be exhaustive or to be construed as limiting the scope of the invention to the precise forms disclosed.

DETAILED DESCRIPTION

Referring first to FIG. 1, a compressor assembly 10 for compressing a high pressure refrigerant, such as carbon dioxide, is shown. Compressor assembly 10 includes housing 12 having a substantially cylindrical main housing member 12*a* and opposing end housing members 12*b*, 12*c*. End housing members 12*b*, 12*c* are hermetically sealed to opposite ends of main housing member 12*a* by a method such as welding, brazing, or the like to define sealed interior volume 40. Housing members 12*a*, 12*b*, and 12*c* may be formed of sheet steel, aluminum or another rigid material having a thickness and strength sufficient to withstand the heat of hermetic sealing and the pressures resulting from operation of the compressor.

Motor assembly 14 is disposed in interior volume 40 and includes rotor 16 and stator 18, which surrounds rotor 16 and drives the rotation of rotor 16 about a rotational axis. Shaft 20 extends through rotor 16 along the rotational axis and is secured to rotor 16 for rotation therewith.

As illustrated in FIG. 1, compressor assembly 10 may be a multi-stage compressor, or, in the alternative, the compressor assembly may be a single-stage compressor. The illustrated compressor assembly 10 includes first and second compressor mechanisms 22, 24 disposed in interior volume 40. First and second compressor mechanisms 22, 24 are coupled to opposite ends of shaft 20 to operably connect first and second compressor mechanisms 22, 24 to motor assembly 14.

Figure 1A:
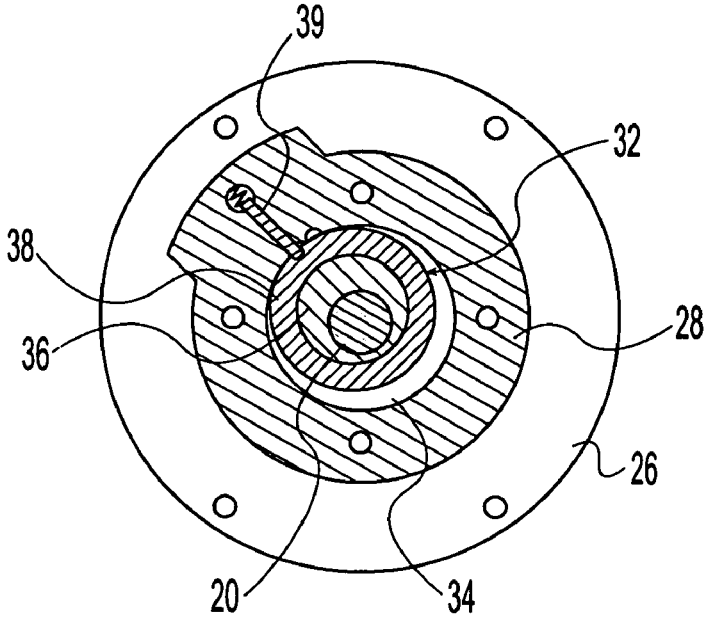
FIG. 1A is a sectional view of the compressor mechanism of the compressor assembly of FIG. 1 taken along lines 1A-1A.

As shown in FIGS. 1 and 1A, first and second compressor mechanisms 22, 24 are identical rotary compressor mechanisms. Alternatively, first and second compressor mechanisms may be any suitable type of compressor mechanism including reciprocating piston type, scroll type, or centrifugal-type mechanisms. Furthermore, first and second compressor mechanisms 22, 24 need not be of identical type, but may be of different types. The use of compressor mechanisms to form a hermetically sealed multi-stage compressor assembly is well known to those having ordinary skill in the art and the present invention may be implemented using conventional compressor mechanisms.

Each of first and second compressor mechanisms 22, 24 includes crankcase 26, annular cylinder block 28, cylinder head 30 and roller assembly 32. Cylinder block 28 is mounted between crankcase 26 and cylinder head 30. Cylinder head 30, cylinder block 28 and crankcase 26 are secured to one another and cooperate to form compression chamber 34 in which the compressible refrigerant may be compressed. Roller assembly 32 is disposed within compression chamber 34 and includes eccentric roller 36 and main roller 38, which is rotatably mounted about eccentric roller 36. Eccentric roller 36 is operably coupled to drive shaft 20, the rotation of which causes roller assembly 32 to orbit within compression chamber 34. Vane 39 (FIG. 1A) is slidingly disposed within a slot defined in cylinder block 28 and engages the outer surface of main roller 38 such that compression chamber 34 is non-continuous. As roller assembly 32 orbits, the cylindrical outer surface of main roller 38 travels along and sealingly engages the wall of compression chamber 34 to compress refrigerant fluid therein in a manner well known in the art.

Referring to FIG. 1, crankcase 26 defines a substantially cylindrical perimetrical sidewall that firmly and sealingly bears against main housing member 12*a*. As a result of the sealed engagement between crankcases 26 and housing 12, crankcases 26 of first and second compression mechanisms 22, 24 cooperate with housing 12 to sealingly divide interior volume 40 into suction plenum 42, intermediate plenum 44 and discharge plenum 46. Suction plenum 42 comprises that portion of interior volume 40 located between the crankcases 26 of first and second compression mechanisms 22, 24. Intermediate plenum 44 represents that portion of interior volume 40 located between crankcase 26 of first compression mechanism 22 and end housing member 12*b* of housing 12. Discharge plenum 46 represents that portion of interior volume 40 located between crankcase 26 of second compression mechanism 24 and end housing member 12*c*.

As illustrated in FIG. 1, housing 12 defines suction inlet 48, which is adapted to communicate compressible refrigerant from suction refrigerant line 47 to suction plenum 42. Suction plenum 42 is in communication with compression chamber 34 of first compressor mechanism 22 via inlet passageway 49 (shown in phantom), which extends through crankcase 26 of first compressor mechanism 22. Housing 12 defines intermediate discharge opening 50, which extends through housing 12 and communicates with intermediate plenum 44. Housing 12 also defines intermediate suction opening 52. Intermediate suction opening 52 extends through housing 12 and communicates with compression chamber 34 of second compressor mechanism 24 via inlet passageway 53 (shown in phantom), which extends through crankcase 26 of second compressor mechanism 24. Intermediate suction line 51 extends from intermediate discharge opening 50 to intermediate suction opening 52 to communicate refrigerant from intermediate plenum 44 to compression chamber 34 of second compressor mechanism 24. A discharge port 31 (shown in phantom) is defined in cylinder head 30 of each of first and second compressor mechanisms 22, 24 and is adapted to communicate refrigerant from compression chamber 34 of each of first and second compressor mechanisms 22, 24 to intermediate plenum 44 and discharge plenum 46, respectively. Discharge valves (not shown) may also be used with the discharge ports 31. Housing 12 defines discharge outlet 54, which is adapted to communicate compressed refrigerant from discharge plenum 46 to discharge refrigerant line 57.

In normal operation, compressible refrigerant fluid from suction line 47 enters suction plenum 42 through suction inlet 48 at suction pressure. From suction plenum 42 the refrigerant is drawn through inlet passageway 49 and into compression chamber 34 of first compressor mechanism 22 where it is compressed to an intermediate pressure by orbiting roller assembly 32 of first compressor mechanism 22. The refrigerant at intermediate pressure is then discharged from compression chamber 34 into intermediate plenum 44 through discharge port 31 of first compressor mechanism 22. The refrigerant exits intermediate plenum 44 through intermediate discharge opening 50 and enters intermediate refrigerant line 51. The refrigerant flows through intermediate refrigerant line 51 to intermediate suction opening 52. The refrigerant is drawn through intermediate suction opening 52 and inlet passageway 53 and into compression chamber 34 of second compressor mechanism 24 where it is compressed to a discharge pressure by roller assembly 32 of second compressor mechanism 24. From compression chamber 34 of second compressor mechanism 24 the refrigerant at discharge pressure is discharged through discharge port 31 and into discharge plenum 46. The refrigerant at discharge pressure exits compressor assembly 10 via discharge outlet 54 and flows to discharge line 57.

Figure 2:
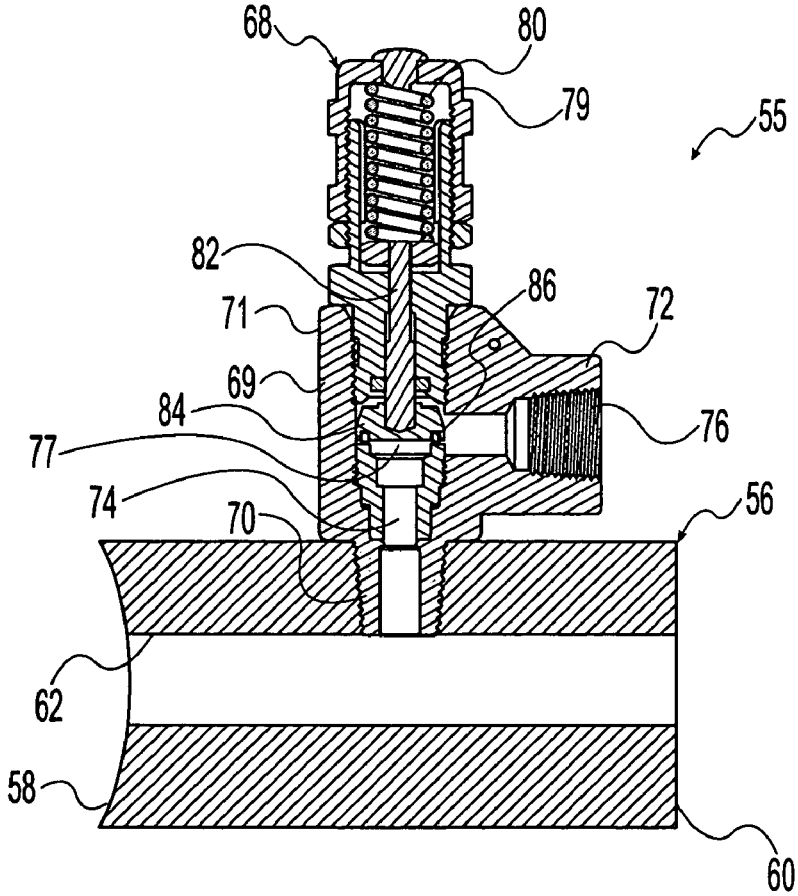
FIG. 2 is a view of sectional view of a pressure relief assembly according to one embodiment of the present invention.

To prevent the pressure within housing 12 from exceeding the maximum operating pressure, compressor assembly 10 may include one or more pressure relief assemblies 55, shown in FIG. 2. As is illustrated in FIGS. 1 and 8-10 and described in further detail below, a pressure relief assembly 55*a*, 55*b*, 55*c* may be positioned to communicate with suction inlet 48, intermediate discharge opening 50, intermediate suction opening 52 and/or discharge outlet 54.

Referring to FIGS. 1 and 2, each pressure relief assembly 55 generally includes fitting 56 and pressure relief valve 68. As illustrated in FIGS. 3A-3D, fitting 56 is a solid, substantially cylindrical structure defining a first end 58 and an opposite second end 60. The fittings 56 need not be cylindrical in shape, but may alternatively have a rectangular, cubic, or any other suitable shape. Fitting 56 is formed of a rigid material, preferably a hard metal such as steel, aluminum, copper or suitable alloy. Fitting 56 defines a passageway 62, which extends through the center of fitting 56 from first end 58 to second end 60. Fitting 56 also includes a threaded duct 64 that extends perpendicularly from, and is in fluid communication with, passageway 62.

Figure 5:
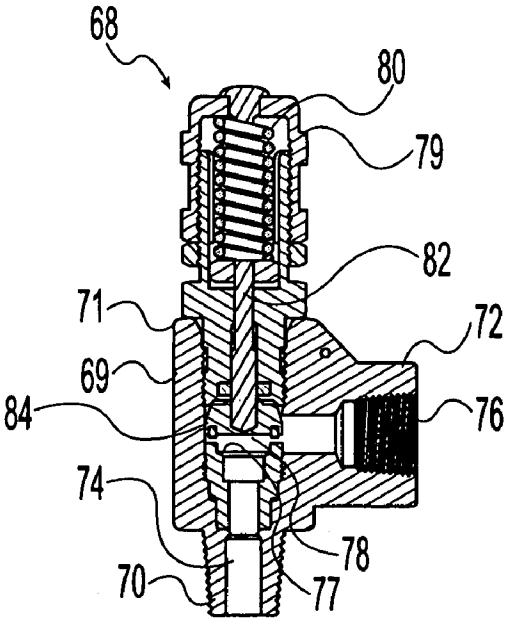
FIG. 5 is a sectional view of the pressure relief valve of FIG. 4.
Figure 4:
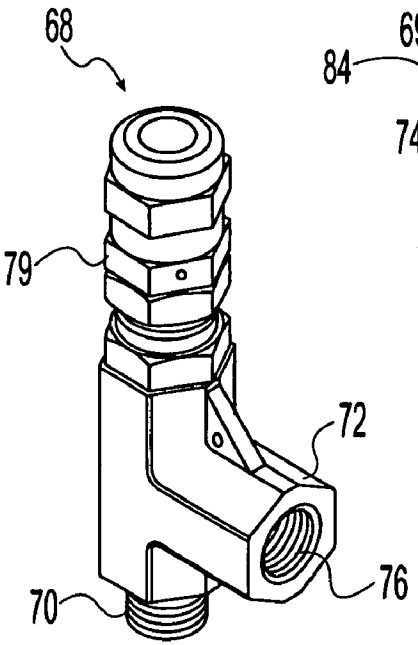
FIG. 4 is a perspective view of the pressure relief valve of the pressure relief assembly of FIG. 2.
Figure 8:
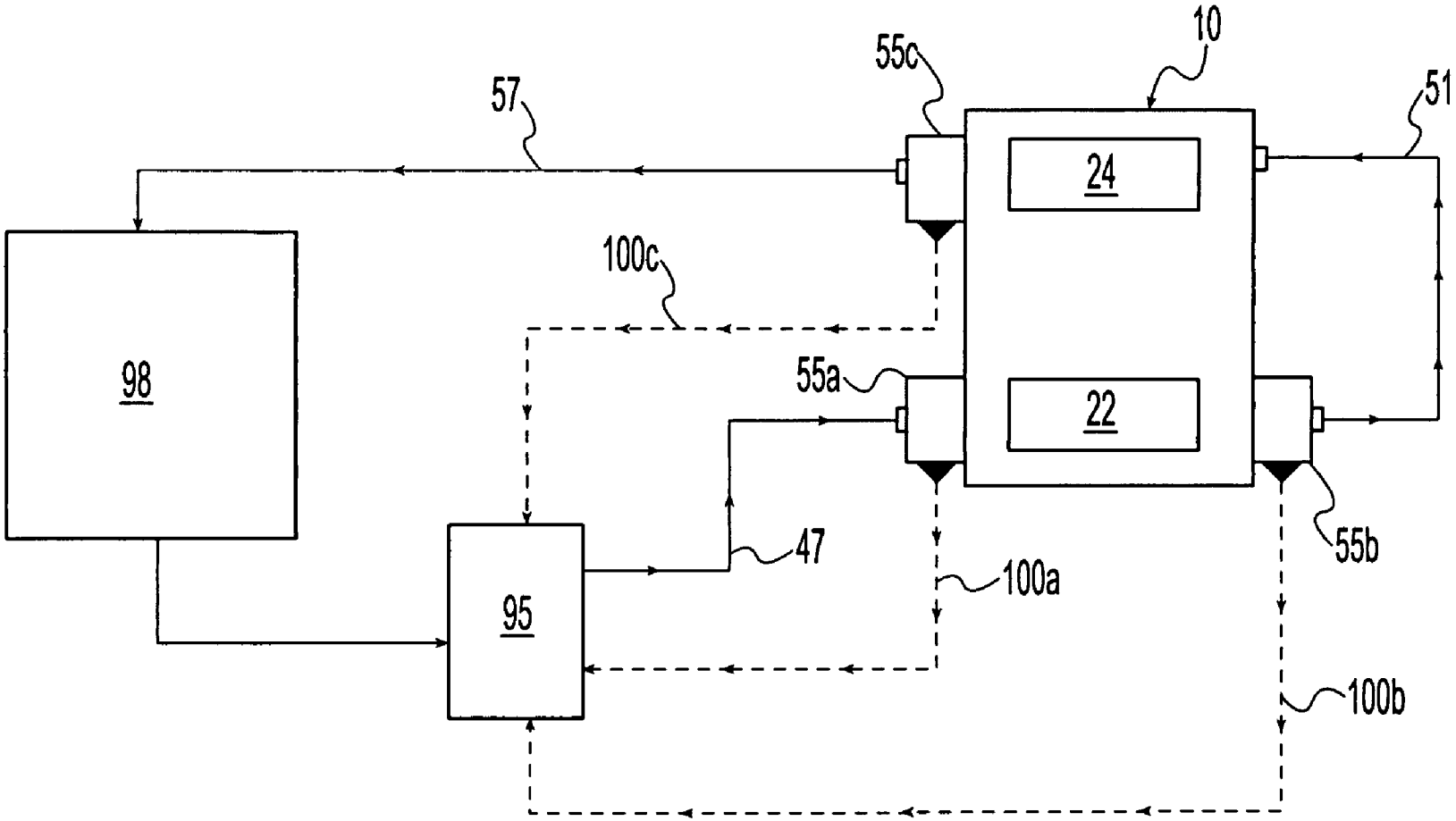
FIG. 8 is a schematic drawing of a refrigeration system having a compressor assembly with pressure relief assembly according to one embodiment of the present invention.
Figure 9:
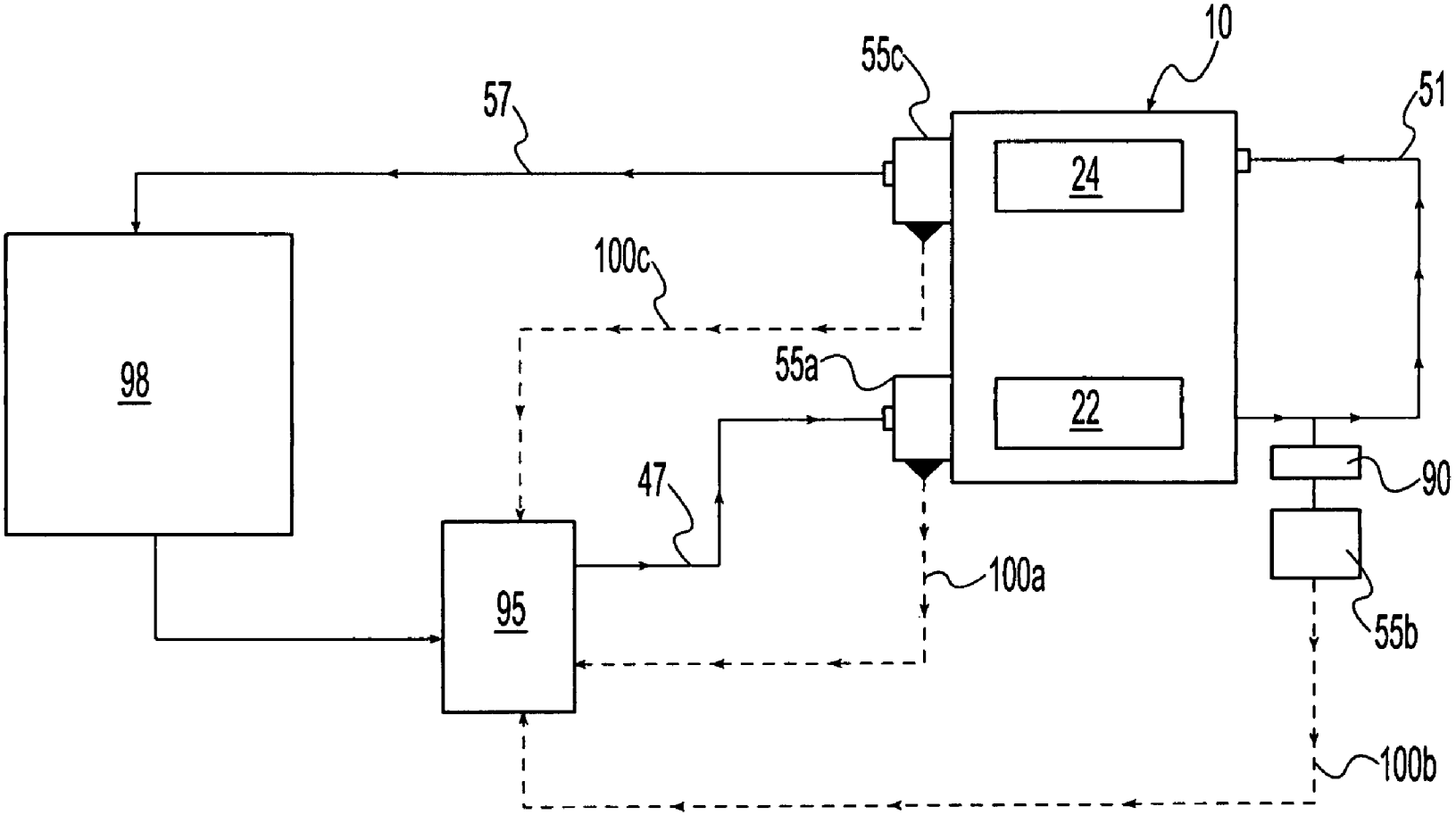
FIG. 9 is a schematic drawing of a refrigeration system having a compressor assembly with pressure relief assembly according to another embodiment of the present invention.

In the illustrated embodiments, relief valve 68 is a Swagelok® relief valve, part No. SS-4R3A1, available from Swagelok Co. having corporate offices in Solon, Ohio. However, alternative embodiments may employ other types and brands of relief valves. As shown in FIGS. 2 and 4-5, relief valve 68 includes a substantially T-shaped body 69 defining an inlet portion 70 at one end, a valve receiving portion 71 at the opposite end, and an outlet portion 72 extending perpendicularly from inlet portion 70 and valve receiving portion 71. Inlet portion 70 is externally threaded for securely engaging threaded duct 64 of fitting 56, as illustrated in FIG. 2. Inlet and outlet portions 72 define inlet and outlet passages 74, 76 respectively, which fluidly join one another at junction 78, as shown in FIGS. 2 and 5. Inlet passage 74 fluidly communicates with junction 78, and thereby outlet passage 76, through opening 77. Inlet passage 74 is also in fluid communication with passageway 62 of fitting 56 when inlet portion 70 is engaged in duct 64 of fitting 56. As shown in FIGS. 1 and 8-9 and described in further detail below, outlet portion 72 is coupled to one of corresponding refrigerant relief lines 100*a*, 100*b*, 100*c*, which are adapted to communicate fluid from outlet passage 76 to another location in the refrigerant circuit. Referring back to FIGS. 2 and 5, valve receiving portion 71 houses valve mechanism 79, which includes spring 80, rod 82, and valve plunger 84. Rod 82 is coupled at one end to spring 80 and at the opposite end to valve plunger 84 to operably connect plunger 84 to spring 80. Valve plunger 84 is slidingly disposed within junction 78 and is movable between a closed position and an open position. In the closed position, shown in FIG. 2, plunger 84 is sealingly seated over opening 77 thereby blocking fluid communication between inlet passage 74 and outlet passage 76. As shown in FIG. 2, plunger 84 may include an O-ring 86 to aid in sealing opening 77 from passage 76. In the open position, shown in FIG. 5, valve plunger 84 is drawn away from opening 77, thereby allowing fluid communication between inlet and outlet passages 74, 76.

Although fitting 56 and relief valve 68 are shown and described herein as being separate components, fitting 56 and relief valve 68 may alternatively be integrated into a single housing, the housing including passageway 62, valve receiving portion 71, and valve mechanism 79.

Figure 3A:
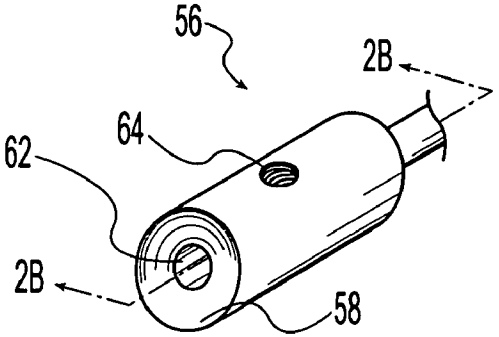
FIG. 3A is a first end perspective view of the fitting of the pressure relief assembly of FIG. 2.
Figure 3B:
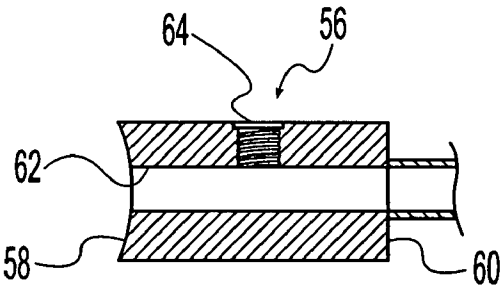
FIG. 3B is a sectional view of the fitting of the pressure relief assembly of FIG. 2.
Figure 6:
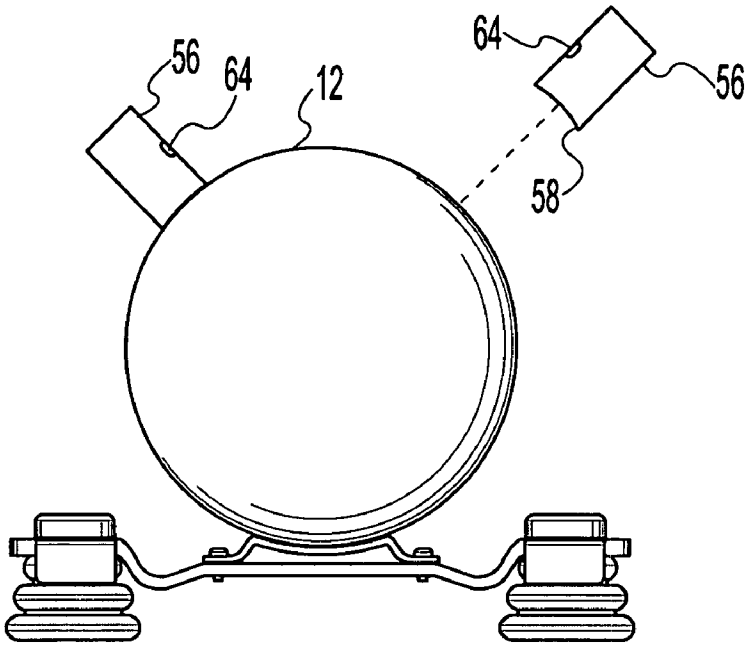
FIG. 6 is an end view of a compressor assembly with a pressure relief assembly exploded therefrom according to another embodiment of the present invention.
Figure 7:
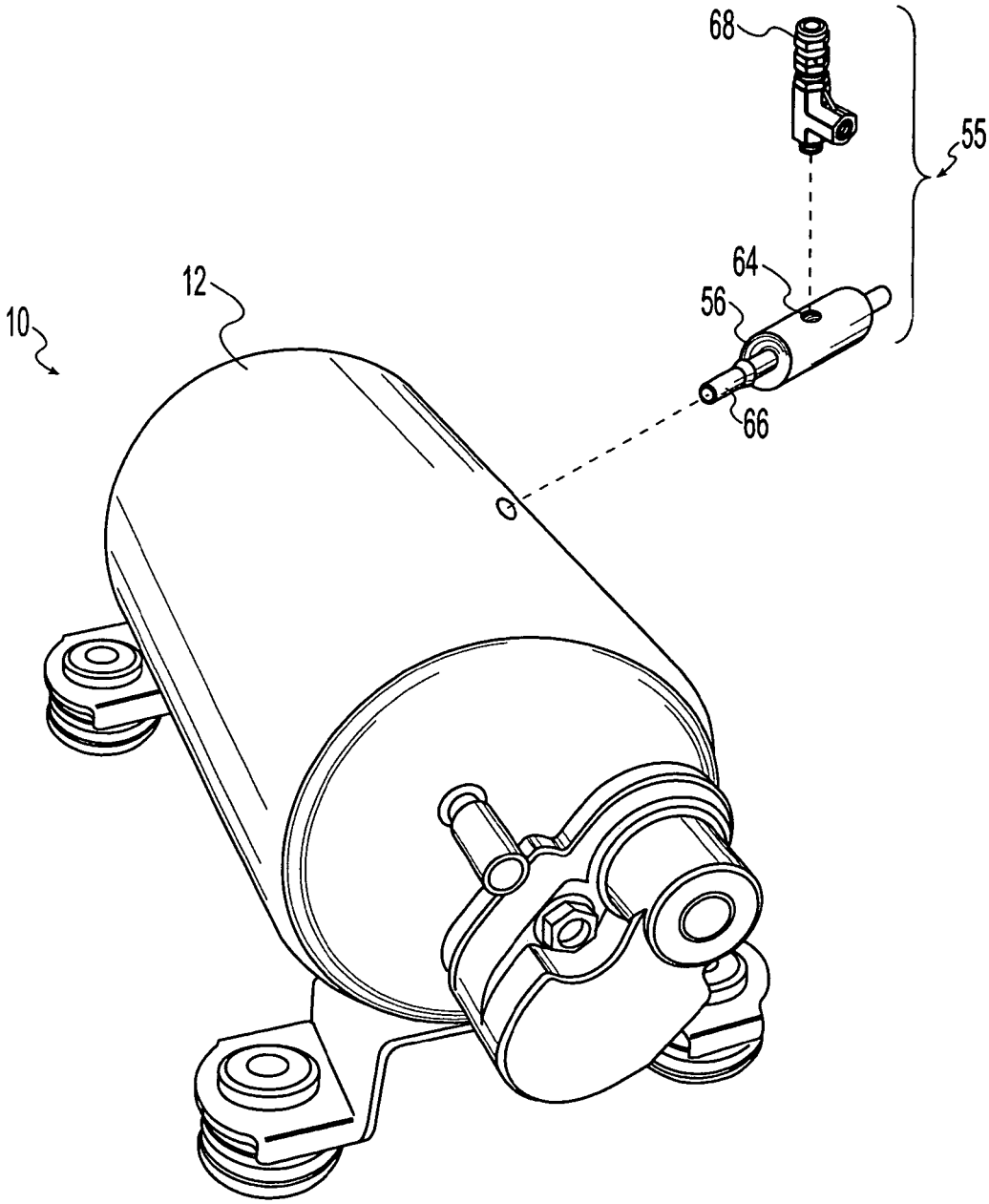
FIG. 7 is a top perspective view of a compressor assembly with the fitting and the pressure relief valve exploded therefrom according to another embodiment of the present invention.

As illustrated in FIGS. 1, 6 and 7, fitting 56 of one or more of pressure relief assemblies 55*a*, 55*b*, 55*c* may be mounted by welding or other suitable methods directly on the exterior surface of housing 12. In this embodiment, first end 58 of fitting 56 defines an arcuate mounting surface having a curvature complementary to that of the exterior surface of main housing member 12*a*, as shown in FIGS. 2, 3A and 3B. Turning back to FIGS. 1, 6 and 7, fitting 56 is mounted on the exterior surface of housing 12 such that first end 58 lies flush against the exterior surface of housing 12 and passageway 62 is aligned with either suction inlet 48, intermediate discharge opening 50, intermediate suction opening 52 or discharge outlet 54. Alternative methods of securing fitting 56 to housing 12 may also be employed.

Figure 3C:
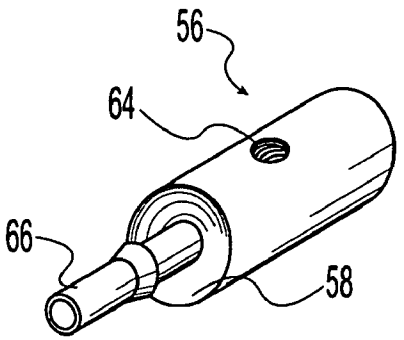
FIG. 3C is a first end perspective view of a fitting of a pressure relief assembly according to another embodiment of the present invention.
Figure 3D:
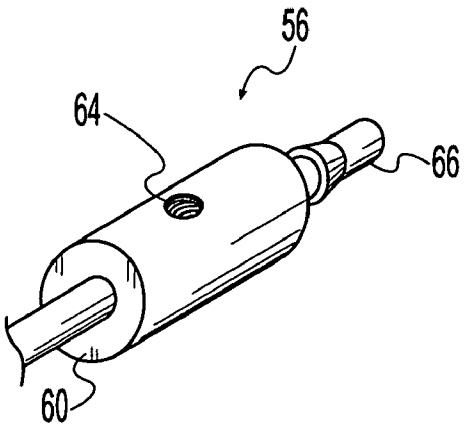
FIG. 3D is second end perspective view of the fitting of a pressure relief assembly according to another embodiment of the present invention.

Fitting 56 is also secured to a refrigerant line and a pipe coupling assembly, such as tapered coupling tube 66 and threaded nut as shown in FIGS. 3C, 3D and 7 may be employed to provide a fluid tight connection with a refrigerant line such as suction line 47, intermediate line 51 or discharge line 57 to place such refrigerant line in fluid communication with passageway 62 of fitting 56. When using tube coupling 66, the refrigerant line will have a threaded end that is forced over the tapered collar located on tube extending from fitting 56. A threaded nut (FIG. 3C) is located between the tapered collar and the body of fitting 56 and engages the threaded end of the refrigerant line to secure the line to the fitting. The refrigerant line may also be connected to fitting 56 in an alternative manner. For example, the refrigerant line may inserted into passageway 62 (FIG. 3B) and then sealingly fixed to fitting 56 by soldering or other suitable method. The positioning of fittings 56 and their cooperation with suction inlet 48, intermediate discharge opening 50, intermediate suction opening 52, discharge outlet 54 and/or the refrigerant lines is discussed in further detail below.

Mounting the pressure relief assemblies on the exterior surface of the housing allows the pressure relief assemblies to be manufactured as a component of the compressor, thereby eliminating the need for post-manufacture installation by the consumer. In addition, mounting the pressure relief assembly on the exterior surface of the housing does not require modification of the housing or other components of the compressor assembly.

Figure 10:
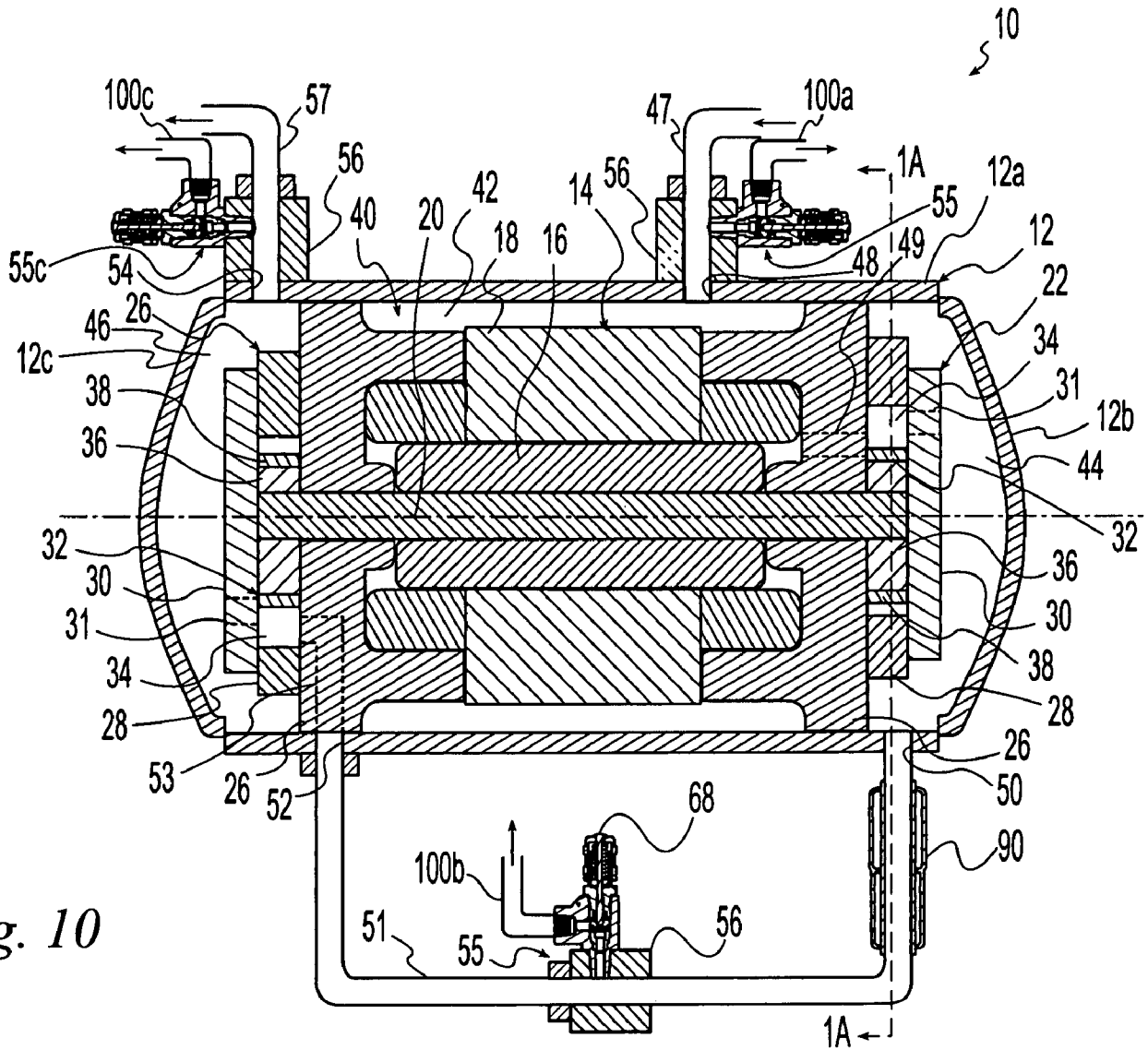
FIG. 10 is a sectional view of another embodiment of a compressor assembly according to the present invention.

In an alternative embodiment shown in FIGS. 9 and 10, fitting 56 of one or more of pressure relief assemblies 55*a*, 55*b*, 55*c* is not mounted directly on the surface of housing 12, but rather is mounted on suction line 47, intermediate refrigerant line 51, and discharge line 57. To reduce noise vibration, damping device 90 may be mounted on suction line 47, intermediate refrigerant line 51, and/or discharge line 57 between fitting 56 and suction inlet 48, intermediate discharge opening 50, and/or discharge outlet 54, respectively. Damping device 90 may be any known damping or muffler device used to attenuate fluid vibrations.

As shown in FIGS. 1 and 8-10, compressor assembly 10 may include one or more pressure relief assemblies 55*a*, 55*b*, 55*c*, which may be positioned to strategically relieve pressure in different areas of compressor assembly 10. For instance, as shown in FIGS. 1 and 8, pressure relief assembly 55*a* may be positioned at and aligned with suction inlet 48 to provide pressure relief to suction plenum 42 and the suction line in communication with suction plenum 42. Similarly, another pressure relief assembly 55*b* may be positioned at and aligned with intermediate discharge opening 50 to provide pressure relief to intermediate plenum 44. Alternatively, the pressure relief assembly 55*b* may be positioned at and aligned with intermediate suction opening 52 to relieve pressure in intermediate plenum 44. Finally, a pressure relief assembly 55*c* may also be positioned in communication with discharge outlet 54 to relieve pressure in discharge plenum 46 or the refrigerant line in communication therewith.

Referring now to FIGS. 1 and 8-10, the operation of pressure relief assemblies 55*a*, 55*b*, 55*c* will now be described. Under normal operating pressures, refrigerant fluid flows through compressor assembly 10 as described in detail above. The refrigerant fluid entering compressor assembly 10 flows from suction line 47 through passageway 62 of pressure relief assembly 55*a* and into suction plenum 42 through suction inlet 48. As the refrigerant flows through passageway 62, fluid enters inlet passage 74 of pressure relief valve 68 (FIG. 2). Under normal operating pressures, spring 80 biases plunger 84 to its closed position, shown in FIG. 2, thereby sealing off opening 77 of inlet passage 74 from outlet passage 76 and preventing the flow of refrigerant to outlet passage 76. When the pressure of the fluid in inlet passage 74 exceeds a predetermined pressure, the force of the refrigerant fluid within inlet passage 74 overcomes the bias of spring 80, thereby forcing plunger 84 to its open position, shown in FIG. 5. In this position refrigerant fluid flows from inlet passage 74 to outlet passage 76, thereby venting fluid and relieving pressure. The refrigerant fluid exits pressure relief assembly 55*a* into a pressure relief line 100*a*, as shown in FIGS. 1 and 8-10, or, in alternative embodiments, the fluid may be vented to the environment. One advantage of the use of carbon dioxide as a refrigerant is that venting carbon dioxide to the environment does not pose the same environmental concerns as venting many other refrigerant fluids. Referring to FIGS. 8 and 9, pressure relief line 100*a* communicates the vented refrigerant fluid to another location in the refrigeration circuit, such as accumulator 95, thereby recycling the refrigerant fluid back into the system, or vents the fluid to the environment. When the pressure within suction plenum 42 drops below the predetermined pressure, spring 80 biases plunger 84 back to its closed position, shown in FIG. 2, and the normal flow of refrigerant fluid through compressor assembly 10 is restored. Normally, refrigerant fluid at discharge pressure flows through line 57 to heat exchanger 98, and thence to accumulator 95.

Pressure relief assemblies 55*b*, 55*c* operate in a similar fashion to relieve excessive pressures within intermediate plenum 44 and discharge plenum 46, respectively. As illustrated in FIGS. 8-10, refrigerant fluid vented by pressure relief assemblies 55*b*, 55*c* exits pressure relief assemblies 55*b*, 55*c* into pressure relief lines 100*b*, 100*c*, respectively. Pressure relief lines 100*b*, 100*c* communicate the vented refrigerant to another location in the refrigerant circuit, such as accumulator 95, thereby recycling the refrigerant fluid, or, in some embodiments, may vent the refrigerant to the environment.

The pressure relief assemblies of the present invention prevent the pressures within the compressor assembly and associated refrigerant lines in communication with the compressor assembly from exceeding predetermined pressures. The pressure relief assemblies may thereby prevent damage to the compressor housing and other vapor compression system components that might be caused by excessive pressures. The pressure relief assemblies may all be configured so that each of the assemblies vent refrigerant at a substantially consistent predetermined pressure, or, the assemblies may be configured whereby the assembly in communication with the suction plenum vents refrigerant at a predetermined pressure which is less than the pressure at which refrigerant is vented by the assembly in communication with the discharge plenum. For example, the use of springs 80 having different biasing forces can be used to provide pressure relief assemblies wherein the assemblies vent refrigerant at different predetermined pressures.

While this invention has been described as having an exemplary design, the present invention may be further modified within the spirit and scope of this disclosure. This application is therefore intended to cover any variations, uses, or adaptations of the invention using its general principles.

What is claimed is:

1. A hermetic compressor assembly for compressing a refrigerant communicated to and from the assembly through a suction refrigerant line and a discharge refrigerant line respectively, said assembly comprising:

a housing enclosing a hermetically sealed interior volume and defining an inlet opening and an outlet opening, the refrigerant being communicated into said interior volume at a suction pressure through said inlet opening and being communicated from said interior volume at a discharge pressure through said outlet opening;

a first compressor mechanism disposed within said interior volume and adapted to compress the refrigerant;

a motor mounted within said housing internal volume and drivingly connected to said compressor mechanism; and a first pressure relief valve assembly including a first fitting mounted on an exterior surface of said housing and positioned over one of said inlet and outlet openings, said first pressure relief valve assembly including a first passageway communicating the refrigerant between said one opening and a respective one of the suction and discharge refrigerant lines, a first duct in communication with said first passageway, and a first pressure relief valve connected to said fitting and being in communication with said first duct;

said fitting being a separate element from said housing and having an arcuate mounting surface complementary to the exterior surface of said housing to which the fitting is mounted.

2. The compressor assembly of claim 1 further comprising a second pressure relief valve assembly including a second fitting mounted on said exterior surface of said housing and positioned over the other of said inlet and outlet openings, said second pressure relief valve assembly including a second passageway communicating the refrigerant between said other opening and a respective one of the suction and discharge refrigerant lines, a second duct in communication with said second passageway, and a second pressure relief valve connected to said second fitting and being in communication with said second duct;

said second fitting being a separate element from said housing and having an arcuate mounting surface complementary to the exterior surface of said housing to which the second fitting is mounted.

3. The compressor assembly of claim 1 wherein said first duct comprises a threaded bore hole and said first pressure relief valve is threadingly mounted in said threaded bore hole.

4. The compressor assembly of claim 1 wherein said first fitting is welded to said exterior surface.

5. The compressor assembly of claim 1 wherein said first fitting is in communication with said outlet opening.

6. The compressor assembly of claim 5 further comprising a second compressor mechanism disposed within said interior volume and wherein said compressor assembly compresses the refrigerant in two stages.

7. The compressor assembly of claim 6 wherein said compressor assembly defines an intermediate pressure chamber disposed within said interior volume and through which refrigerant is communicated from said first compressor mechanism to said second compressor mechanism, said housing includes a third opening in communication with said intermediate pressure chamber and said compressor assembly further comprises a third pressure relief valve assembly in communication with said intermediate pressure chamber through said third opening.

8. The compressor assembly of claim 7 wherein said third pressure relief valve assembly includes a third fitting mounted to said exterior surface of said housing over said third opening, a third passageway communicating refrigerant between said third opening and a refrigerant line, a third duct in communication with said third passageway, and a third pressure relief valve in communication with said third duct.

9. The compressor assembly of claim 7 further comprising a pulse damping device operably disposed between said third pressure relief valve assembly and said third opening.

10. The compressor assembly of claim 1 further comprising a pulse damping device operably disposed between said first fitting and said first pressure relief valve.

11. The compressor assembly of claim 1 wherein said housing defines a third opening in communication with said interior volume and said compressor assembly further comprises a third pressure relief valve assembly in communication with said interior volume through said third opening.

12. The compressor assembly of claim 11 wherein said third pressure relief valve assembly further comprises a third fitting mounted to said exterior surface of said housing over said third opening.

* * * * *